United States Patent [19]

Wright

[11] 4,290,527

[45] Sep. 22, 1981

[54] SLUICE CONSTRUCTION

[76] Inventor: Winston F. Wright, 2660 Fair Cir., Reno, Nev. 89503

[21] Appl. No.: 177,796

[22] Filed: Aug. 13, 1980

[51] Int. Cl.[3] ..... B03B 4/00; B03B 5/06

[52] U.S. Cl. ..... 209/12; 209/44; 209/437; 209/458; 209/471; 209/477

[58] Field of Search ..... 209/12, 44, 315, 437, 209/446, 455, 458, 468, 471, 475, 477, 485, 486, 504, 506

[56] References Cited

U.S. PATENT DOCUMENTS

| | | | |
|---|---|---|---|
| 73,306 | 1/1868 | Donnelly | 209/437 |
| 247,077 | 9/1881 | Lodwick | 209/44 |
| 372,741 | 11/1887 | Card | 209/44 X |
| 1,429,750 | 9/1922 | Marsh | 209/437 X |
| 1,591,420 | 7/1926 | Garcia | 209/44 X |
| 1,811,117 | 6/1931 | Farnell | 209/44 X |
| 2,091,620 | 8/1937 | Williams | 209/437 X |
| 2,308,077 | 1/1943 | Hart | 209/458 |
| 2,696,303 | 12/1954 | George | 209/458 |

*Primary Examiner*—William A. Cuchlinski, Jr.
*Attorney, Agent, or Firm*—Charles E. Temko

[57] ABSTRACT

An improved continuous run sluice box having a sonic vibration and ultrasonic vibration means for concentrating gold or other precious metals while eliminating the loss of black sands containing other valuable fines normally accompanying the use of conventional sluices. The sluice includes a novel type riffle construction including a vertical wall and a sloping wall leading to a collecting area having a nylon cloth screen positioned between coarse and fine metallic screens which facilitates both the collection of the fines and the release of the same during flushing operations.

3 Claims, 4 Drawing Figures

SLUICE CONSTRUCTION

RELATED APPLICATION

Reference is made to my copending application Ser. No. 057,751, filed July 16, 1979 which discloses a related invention.

BACKGROUND OF THE INVENTION

This invention relates generally to the field of placer mining, and more particularly to an improved form of continuous run sluice box adapted for operation with little if any down time for cleaning.

In the traditional placer mining process, large amounts of ore and sands are continuously washed in a sluice which is not subjected to constant vibration. The heavier precious metal and accompanying black sands sink to the bottom of the sluice, and the lighter weight sands and other other impurities are washed away. Large scale placer mining is relatively inefficient, in that the black sands which accompany the precious metals often, with further refining, will realize other products which are worth as much or more as the recovered precious metal. In the traditional sluice, the riffles or transversely extending walls disposed at substantially equally spaced intervals, periodically become filled and packed with recovered material, and operation must then be halted so that the material can be removed, usually as a hand operation. During this period, no washing of ore can take place.

In the above identified copending application, a construction is disclosed in which the device is provided with a pair of oppositely facing sluice channels, mounted on a common frame for rotation about a single longitudinal axis. The upper sluice channel, at any one moment, is in operation, while the other sluice channel is downwardly faced to facilitate the freeing of collected material from the riffles by an air or water flushing operation, so that it may drop under the action of gravity into a holding tank or other receptacle for collection. This flushing is accompanied by the normal vibration which occurs during operation of the sluice imparted by a reciprocating motor driven means, and, in addition, an ultrasonic vibration is also introduced to facilitate the loosening of collected material. While this construction is quite effective, I have found that the clearing of the riffles can be substantially improved while simultaneously improving the mineral collecting ability of the riffle structure.

SUMMARY OF THE INVENTION

Briefly stated, the invention contemplates in a device as disclosed in my above identified copending application of an improved type riffle assembly in which each riffle includes a vertically extending wall, the rear surface of which merges with an inclined wall leading to a relatively narrow collection area positioned immediately ahead of the vertical wall of the next succeeding riffle. The collection area includes a plurality of porous laminae, including an uppermost relatively fine stainless steel screen overlying a nylon cloth screen, the nylon cloth screen being supported by a relatively coarse stainless steel screen thereunder. The slanted wall leading from the vertical wall to the collection area facilitates the passing of lighter materials from the discharge end of the riffle as the heavier materials sink to the collection area. The nylon cloth screen develops a static electrical charge under imparted vibrations, which creates a holding action for very fine material, especially in the dry state until the material is dumped, at which time the holding action is overcome by the force of gravity. Beneath the cloth screen is a passage supplying a pulsating air or water current to provide an improved jigging action.

BRIEF DESCRIPTION OF THE DRAWING

In the drawing, to which reference will be made in the specification, similar reference characters have been employed to designate corresponding parts throughout the several views.

DETAILED DESCRIPTION OF THE DISCLOSED EMBODIMENT

Figure 1:
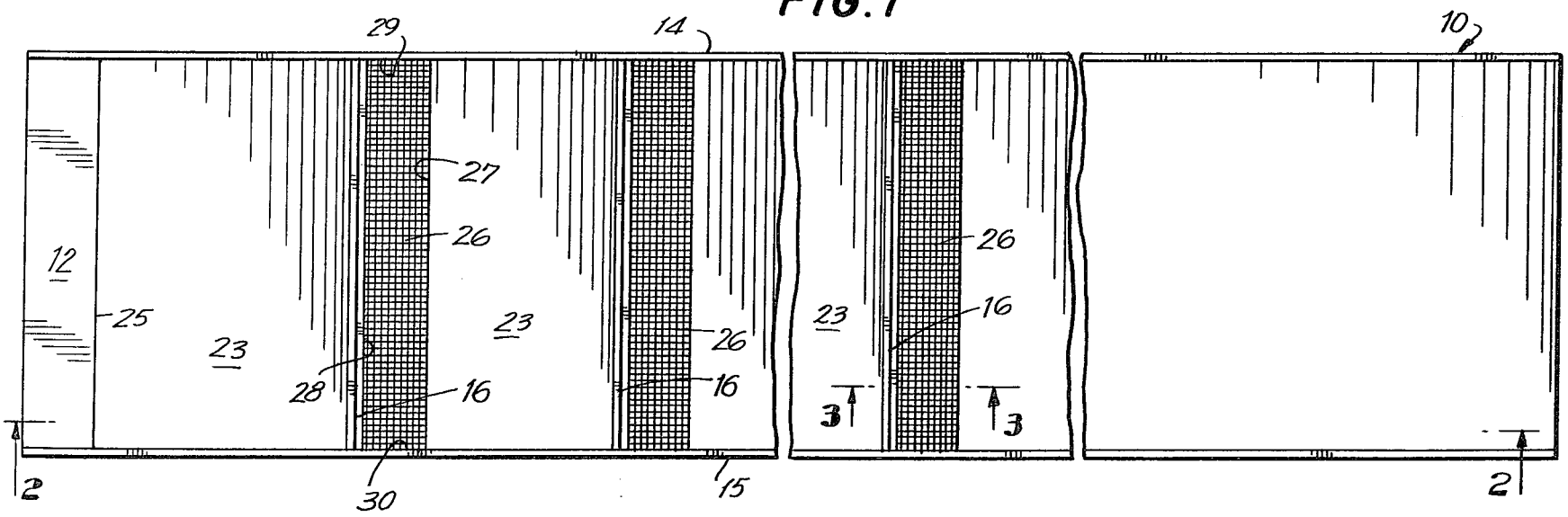
FIG. 1 is a top plan view of a sluice element embodying the present invention.
Figure 2:
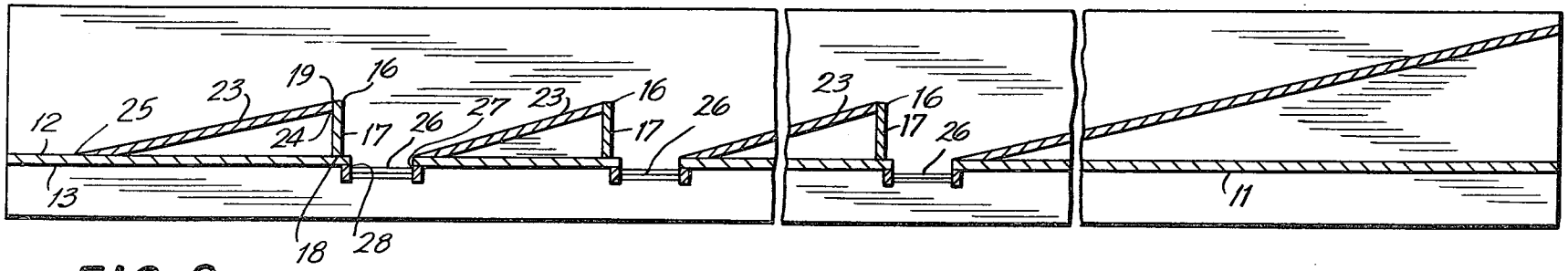
FIG. 2 is a vertical longitudinal sectional view thereof.

In accordance with the invention, the device, generally indicated by reference character 10, comprises a sluice element of a type suitable for use in conjunction with the structure disclosed in my abovementioned copending application, to which reference is made. It includes a bottom wall 11 having an upper surface 12 and a lower surface 13. Interconnecting with the longitudinal edges of the bottom wall are first and second side walls 14 and 15 which, together with the bottom wall 11 form a channel to which a mineral slurry passes. Medially positioned between the upper and lower ends of the bottom wall 11 are a plurality of riffle units 16.

Each of the riffle units 16 is substantially similar, and includes a vertically upstanding wall 17, a lower edge 18 of which is supported by the upper surface 12 of the bottom wall. The upper edge 19 is disposed below the upper edges of the side walls 14 and 15, as is usual in constructions of this type.

Extending downwardly from the upper edge 19 is a sloping wall 23, the upper edge 24 of which is juxtaposed therewith. A lower edge 25 is supported by the upper surface 12 adjacent a rectangular opening 26 bounded by a leading transverse edge 27, a trailing transverse edge 28 and end edges 29 and 30.

Figure 3:
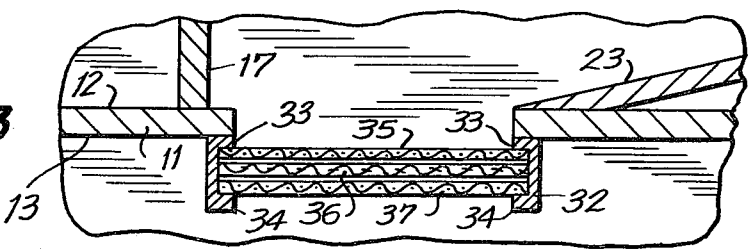
FIG. 3 is an enlarged vertical fragmentary sectional view as seen from the plane 3—3 in FIG. 1.

Disposed below the openings 26 is a replacable frame 32 which may include upper and lower frame members 33 and 34 (FIG. 3) between which are positioned in congruent relation an upper relatively fine mesh stainless steel screen 35, an even finer mesh nylon screen 36, the screen 36 being supported by a relatively coarse metallic mash screen 37.

Figure 4:
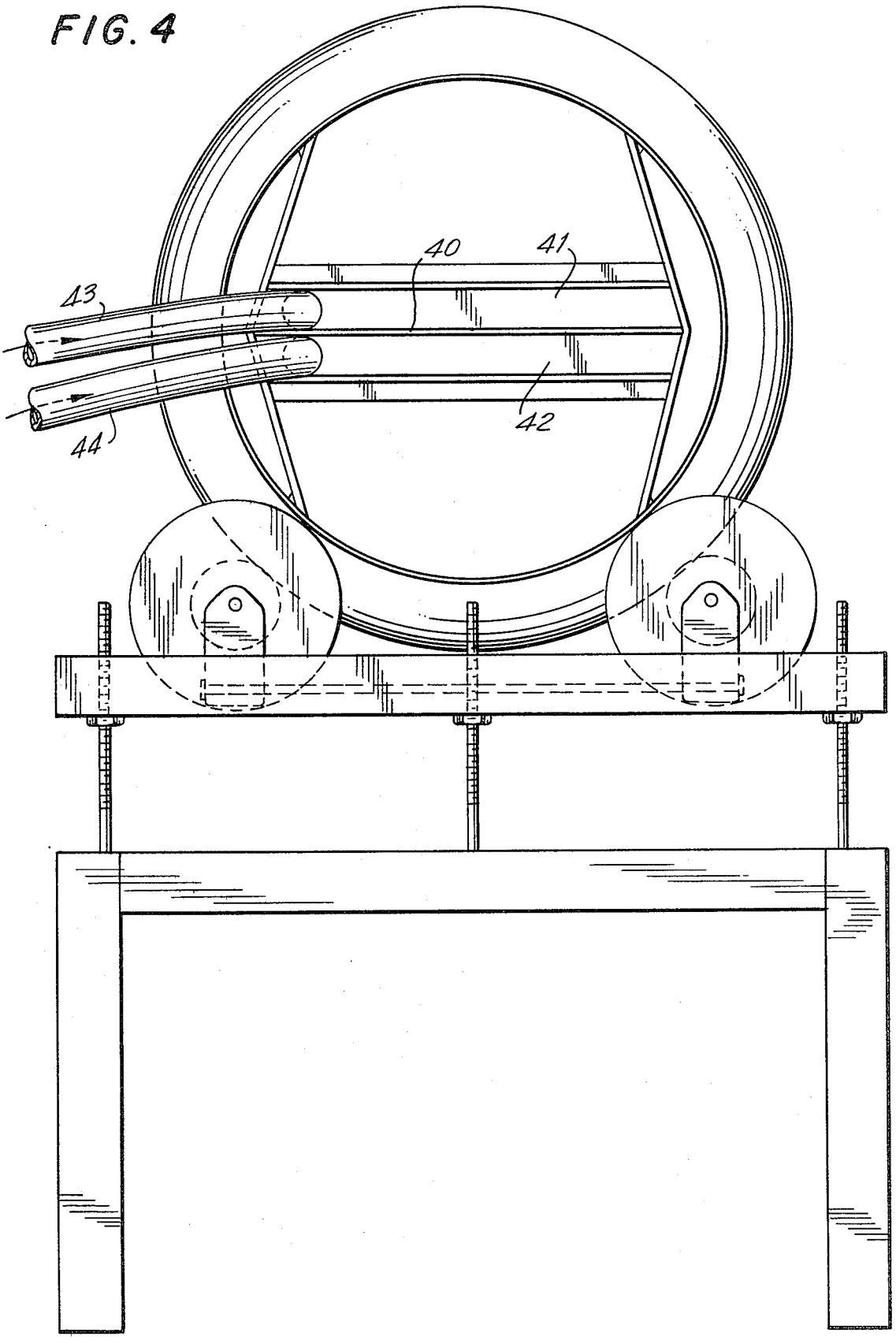
FIG. 4 is an end elevational view showing the sluice element of FIG. 1 in combination with a known sluice construction.

Referring to FIG. 4 in the drawing, two sluice elements are positioned as described in my abovementioned copending application in oppositely facing orientation. Disposed between them is a septum 40 forming a pair of passageways 41 and 42, each of which is provided with a hose at 43 and 44 supplying pulsating air or water selectively to the sluice element in operation to provide an effective jigging operation.

During operation, the presence of the sloping facilitates the separation of relatively heavier materials from relatively lighter ones, separation commencing immediately after the slurry has passed over the vertical wall relative to each riffle unit. By the time the heavier components have reached the rectangular opening at the lower edge of the inclined wall, they have lost considerable velocity relative to the velocity of the slurry, and fall upon the upper fine mesh screen to be retained thereby. As a result of vibration being constantly imparted to the sluice element, the nylon screen develops a small charge of static electricity which tends to retain the heavier components of the fine mesh screen. The lower screen 37 serves purely a supportive function for the nylon screen 36.

Once inverted, the porosity of the screens facilitates a flushing action either by air or water which permits the nylon screen to be thoroughly cleansed owing to its porosity.

I am aware that it is known in the art to use cloth screens for mineral separation. However, the presence of a fine mesh screen above the nylon screen materially improves its life expectancy, as does the supportive effect of the lower coarse screen, which prevent undue contact of the minerals therewith, and a shielding therefrom from normal abrasive action.

I wish it to be understood that I do not consider the invention limited to the precise details of structure shown and set forth in this specification, for obvious modifications will occur to those skilled in the art to which the invention pertains.

I claim:

1. In a sluice element for mineral recovery comprising a lower wall, a pair of side walls bordering the longitudinal edges of said bottom wall to define a sluice channel, and a plurality of riffles for separating the solids from a liquid slurry disposed intermediate said first and second ends thereof, the improvement comprising: each of said riffles including a vertical wall having a lower edge supported by said bottom wall and an upper edge terminating below the upper edges of said side walls, a second wall in sloped relation to said vertical wall having an upper edge connecting with said upper edge of said vertical wall, and a lower edge supported by said bottom wall, and terminating a distance from a next vertical riffle wall, said bottom wall having a rectangular opening therein of axial length corresponding to said last mentioned distance; a rectangular frame detachably associated wih said opening, and a plurality of screens in congruent relation supported by said frame to underlie said opening.

2. The improvement in accordance with claim 1, further characterized in said plurality of screens including an upper fine mesh metallic screen, a medially positioned nylon cloth screen, and a coarse mesh metallic screen supporting said nylon screen.

3. The improvement in accordance with claim 1, further comprising means for supplying a pulsating fluid beneath said plurality of screens to effect a jigging action.

* * * * *